US005379201A

United States Patent [19]

Friedman

[11] Patent Number: 5,379,201

[45] Date of Patent: Jan. 3, 1995

[54] PORTABLE LIGHT FOR LAPTOP COMPUTER

[76] Inventor: Arthur S. Friedman, 2144 Seneca West, Merrick, N.Y. 11566

[21] Appl. No.: 179,197

[22] Filed: Jan. 10, 1994

[51] Int. Cl.[6] ..... F21L 7/00

[52] U.S. Cl. ..... 362/191; 362/197; 362/199; 362/253; 362/98; 362/194

[58] Field of Search ..... 362/191, 98, 99, 194, 362/253, 197, 199, 109, 396

[56] References Cited

U.S. PATENT DOCUMENTS

| | | | |
|---|---|---|---|
| 2,329,556 | 9/1943 | Raabe | 362/99 |
| 2,561,744 | 7/1951 | Langdon et al. | 362/99 |
| 2,597,662 | 5/1952 | Melamed et al. | 362/99 |
| 4,432,042 | 2/1984 | Zeller | 362/98 X |
| 4,626,965 | 12/1986 | Gupta et al. | 362/98 X |
| 4,893,222 | 1/1990 | Mintzer | 362/109 |
| 4,949,230 | 8/1990 | Burmeister | 362/109 |
| 5,035,392 | 7/1991 | Gross et al. | 248/442.2 |
| 5,055,977 | 10/1991 | Acquanetta | 362/109 X |
| 5,077,643 | 12/1991 | Leach | 362/183 |
| 5,091,832 | 2/1992 | Tortola et al. | 362/109 |
| 5,117,339 | 5/1992 | Tortola et al. | 362/109 |
| 5,122,941 | 6/1992 | Gross et al. | 362/276 |
| 5,130,907 | 7/1992 | Tortola et al. | 362/109 |
| 5,165,779 | 11/1992 | Tortola et al. | 362/109 |
| 5,183,325 | 2/1993 | Hurdle | 362/253 X |
| 5,192,046 | 3/1993 | Howard | 248/676 |

*Primary Examiner*—Ira S. Lazarus
*Assistant Examiner*—Thomas M. Sember
*Attorney, Agent, or Firm*—Dennison, Meserole, Pollack & Scheiner

[57] ABSTRACT

A portable light for laptop computers comprising a battery pack and a light assembly selectively engageable in a use position with the light assembly extending perpendicular from the upper portion of the battery pack and slidably engaged within mounting clips on the battery pack, and a stored position wherein the battery pack is received substantially co-linear with the light assembly within a storage pocket in the light assembly.

13 Claims, 2 Drawing Sheets

PORTABLE LIGHT FOR LAPTOP COMPUTER

BACKGROUND OF THE INVENTION

The invention is broadly concerned with portable computers of the type commonly referred to as laptop computers wherein the keyboard is selectively closed by an upwardly pivoting cover, the inner face of which comprises the screen or monitor. The cover, when closed, provides a slim profile with all of the operating components fully protected within the attache-type structure.

Such computers, because of their intended use away from an office environment, for example, in airplanes, trains, cars, buses, hotels, worksites, and the like, are, under such circumstances, usually run by battery powerpacks which, as a matter of convenience, are normally multiple interchangeable packs.

However, one particular difficulty noted with regard to such computers is the lack of an appropriate light source. This can be a particular hardship in such locations wherein auxiliary lamps or the like are not normally available.

Laptop computer manufacturers have conventionally made no provision for incorporating a light source in that the laptop computers virtually need all of the power available for operating the computer itself as well as the energy draining laptop viewing screen.

SUMMARY OF THE INVENTION

The primary purpose of the present invention is to provide a portable light source for a laptop computer (laptop) and the like which releasably mounts to the computer and incorporates its own power source.

The portable or travel light, upon an opening of the computer and an upright positioning of the viewing screen, is adapted to mount to the upper or outer edge thereof in an adjustable manner which conforms to any currently known laptop.

The portable light is convertible between a mounting or use position wherein the light conforms to the configuration of the computer lid and is retained thereon by a combination of a frictional clamping action and a counterweight arrangement, and a stored position wherein the portable or travel light is flat, with the components thereof engaged and receivable within a flat pouch, much in the manner of an oversized eyeglass case or the like. When so stored, the portable light is easily carried in one's pocket, a computer accessory case, or the like.

Basically, the portable light includes a light assembly and a separate battery pack. The light assembly includes a forwardly positioned downwardly directed reflector which internally mounts a lamp or light bulb. A housing immediately behind the reflector mounts the electrical circuitry, bulb socket and the like. A combined storage and mounting pocket is provided rearwardly of the circuitry housing and rearwardly directed. This pocket is defined by an elongate top mounting panel, which can be unitarily formed with the top of the circuitry housing and reflector, and a lower parallel substantially shorter latching panel.

The battery pack includes an internal battery chamber with a storage compartment therebelow for extra light bulbs and the like, and an overlying circuitry compartment toward the opposite end of the battery chamber from the storage compartment. A slidably mounted side portion of a wall of the battery pack is in the nature of a closure or door to selectively open the battery chamber and storage compartment.

The circuitry compartment of the battery pack, which defines one end thereof, includes a pair of opposed mounting clips which form opposed inwardly directed slots to slidably receive the opposed longitudinal edges of the mounting panel of the light assembly upon an orientation of the battery pack at right angles to the light assembly. Electrical contact between the battery pack and light assembly can be made through engaging contacts on the undersurface of the mounting panel and the end of the battery pack between the clips, or, alternatively, by a separate wire and jack assembly.

With the battery pack and light assembly joined as described above, the battery pack will lie against the back or outer face of the cover of the laptop computer with the light assembly overlying the screen and rearwardly slid to engage the latching panel with an appropriate portion of the computer cover, either a peripheral lip thereon, a projecting latch, or similar structure whereby the battery pack acts in a manner of a counterweight for the forwardly projecting light assembly, and the edge portion of the computer cover is clamped appropriately between the battery pack and latching panel.

When the light is to be stored, the battery pack is removed from the mounting panel, aligned with the light assembly, and slid into the storage pocket to parallel and underlie the mounting panel.

Additional features and advantages will become apparent from a more detailed description of the invention following hereinafter.

DESCRIPTION OF PREFERRED EMBODIMENT

Figure 1:
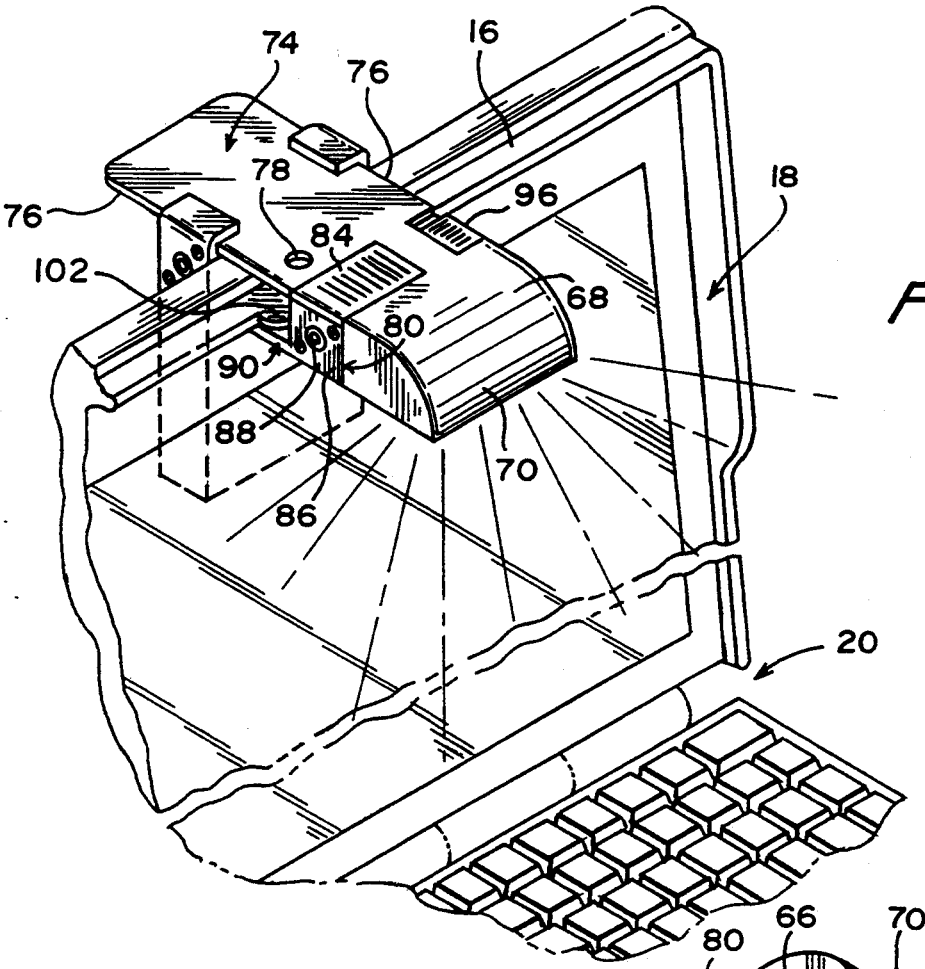
FIG. 1 is a partial perspective view of an open laptop computer with the portable travel light of the invention mounted thereon.

Referring now more specifically to the drawings, the portable or travel light 10 comprises two basic interacting components, a battery pack 12 and a light assembly 14. Noting FIGS. 1, 2 and 3, the two components are assembled in a use position wherein the portable light 10 is particularly adapted for mounting on the outer flanged edge portion 16 of the combined cover and view screen 18 of a laptop computers, commonly referred to as a laptop.

Figure 4:
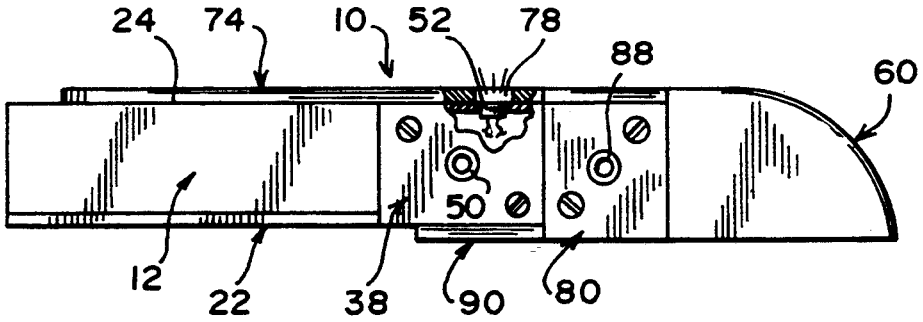
FIG. 4 is a side elevational view, with a portion broken away, illustrating the portable light assembled in its stored position.
Figure 5:
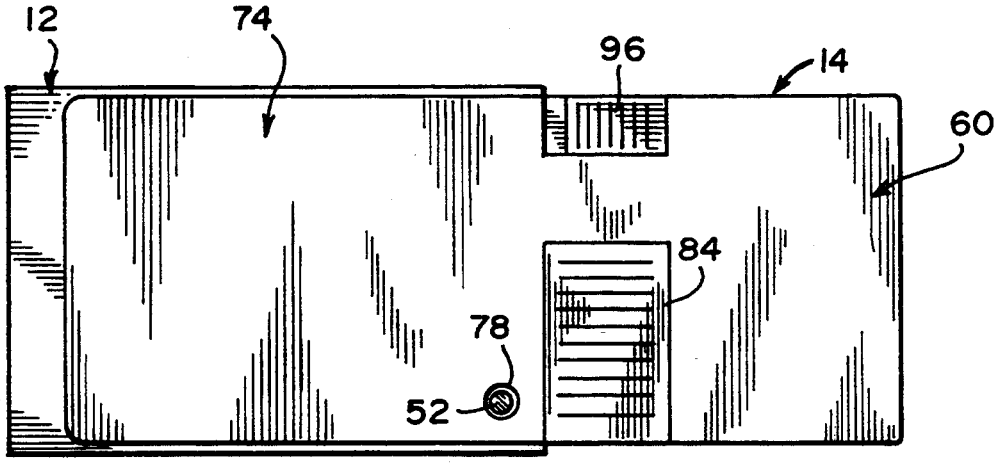
FIG. 5 is a top plan view of the portable light in its stored position.

In a second position, the battery pack and the light assembly, as illustrated in FIGS. 4 and 5, are releasably compacted in a flat storage or stored position, capable of being itself stored within a protective pouch or the like.

The battery pack 12 comprises a relatively flat rectangular body having opposed planar front and rear face walls 22 and 24, substantially flat bottom and top end walls 26 and 28, and opposed substantially flat side walls 30 and 32. The walls define a lower rather shallow storage compartment 34 which extends the full width of the battery pack, a substantially taller battery chamber 36 thereabove, and a wiring compartment 38 including the appropriate wires, contacts, etc. thereabove.

For compactness, it is contemplated that the depth of the battery pack, between the front and rear wall 22 and 24, be only such as to accommodate the depth of a single 1.2 volt AA battery 40, with the width of the battery chamber 36, and hence the battery pack 12, being such as to preferably accommodate four such batteries 40. The lower storage chamber 34 can accommodate spare bulbs, an auxiliary power transfer cable, or the like.

Figure 2:
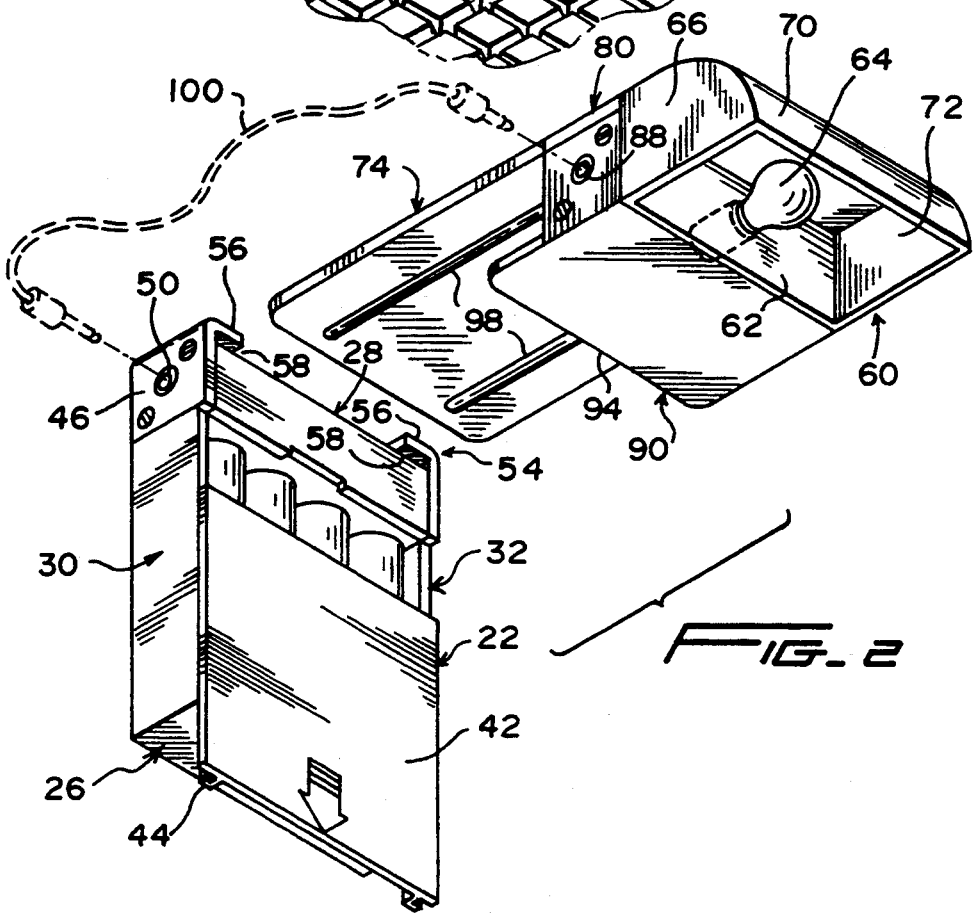
FIG. 2 is an exploded perspective view of the portable light with the two components aligned for mounting the assembly.

The front wall 22, noting FIG. 2, includes a sliding closure panel 42 which is downwardly retracted to selectively open the battery chamber 36 and storage compartment 34, with side guides 44 or the like being provided. The closure panel will be retained in its closed position in any conventional manner such as by friction developed by the side guides 44 or an appropriate releasable snaplock.

Figure 3:
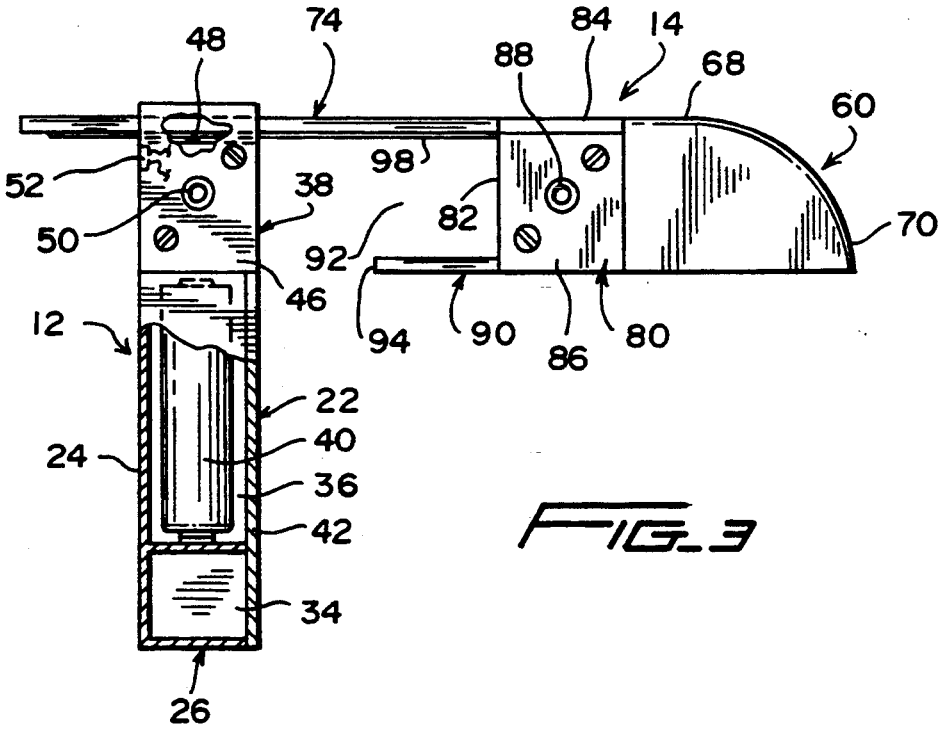
FIG. 3 is a side elevational view, with portions broken away, illustrating the portable light assembled in operative or use position.

As desired, the interior of the wiring compartment 38 can be accessed by an appropriate sliding panel or, as illustrated, screw-mounted removable end panels 46. This compartment 38 will include, projecting through the top wall 28, a pair of electrical contacts or contact buttons 48, one of which is illustrated in FIG. 3. One or more power jack sockets 50 will be provided, preferably through one or both of the end panels 46 and, as it is contemplated the battery pack be rechargeable as a unit, an appropriate LED charging light 52 will be exposed through that portion of the rear wall 24 covering the wiring compartment.

In order to mount the light assembly 14 to the battery pack 12 in the use position, the battery pack includes a pair of opposed mounting clips 54 defined at the opposed ends of the top wall 28 by a pair of laterally inwardly directed flanges 56 which are preferably integral with and extend inwardly from the upper ends of the opposed end wall panel portions 46 to partially overlie the top wall 28 and define a pair of opposed inwardly directed retaining slots 58.

The light assembly 14 includes a forward reflector 60 having a rear wall 62, through which an appropriate bulb or lamp 64 mounts, opposed end walls 66 and an outer or top wall 68 which curves forwardly and downwardly to define a corresponding front wall 70 terminating in a common plane with the lower edges of the end walls 66 and rear wall 62. The reflector walls define a downwardly directed open face 72 and preferably have the inner surfaces of appropriate reflective construction to maximize illumination from the lamp 64.

The outer wall 68, rearward of the arcuate forward wall portion 70 thereof, is preferably integrally formed with an equal width rearwardly extending planar mounting panel 74 having opposed straight side edges 76 and being of a width for snug slidable reception within the opposed facing slots 58 of the mounting clips 54. The mounting panel 74 has a viewing port 78 therein alignable with the charging light 52 in the stored position as best seen in FIG. 4.

A closed housing 80 is formed immediately rearward of the rear wall 62 of the reflector 60 and receives the requisite internal wiring, circuitry, bulb socket and the like. Access to this housing 80, which has a closed rear wall 82, is provided by an appropriate slidable top access panel 84 in the overlying mounting panel 74, and/or a screw mounted end panel 86, preferably having a jack socket 88 therein.

The bottom of the circuitry housing 80 is closed by a planar latch panel 90 which extends rearwardly from the rear wall 62 of the reflector to a point substantially beyond the rear wall 82 of the housing 80 but well short of the rear edge of the parallel overlying mounting panel 74. So positioned, the mounting panel 74 and latching panel 90 define a rearwardly directed storage pocket 92. The pocket 92 is of a height between the latch panel 90 and mounting panel 74 as to snugly although slidably receive the upper portion of the battery pack 12 as illustrated in FIG. 4. In addition, the depth of the pocket 92, forward from the rear edge 94 of the latch panel 90 is such as to receive a sufficient portion of the battery pack 12 to provide for a positive retention of the battery pack 12 substantially co-linear with the light assembly 14. That is, there will be no tendency for the light assembly 14 and battery pack 12 to readily disengage from the stored position of FIGS. 4 and 5 without a physical or manual separation thereof. A slight inherent flexibility in the materials of the latch panel and mounting panel in particular may be of assistance in effecting the desired engagement.

An appropriate off-on slide switch 96 is accessible through the top of the mounting panel 74 over the housing 80, although the location of the switch can vary.

In order to provide for electrical continuity or communication between the battery pack 12 and the lamp assembly circuitry, a pair of elongate contact strips 98 are mounted extending longitudinally along the undersurface of the mounting panel 74 and so aligned as to engage with the contacts 48 projecting from the top wall 28 of the battery pack when the battery pack is assembled to the lighting assembly as in FIGS. 1 and 3. The use of elongate contact strips 98 will, in an obvious manner, allow for relative adjustment between the two main components to accommodate different thickness laptop covers, viewing screens and the like. As an alternative or auxiliary means to provide for power transfer, a connecting wire 100 with jacks mounted on the opposed ends thereof, can be provided for engagement within the jack sockets 50 and 88. Assuming the battery pack is rechargeable as a unit, an appropriate recharging device can be engaged within the battery pack socket 50, or another appropriately provided socket to the battery pack circuitry. It is also contemplated that the portable light, in the use position, be operative directly by line current using the recharging device or an appropriate adapter.

Turning now again to FIG. 1, it will be recognized that in use, the light assembly will be positioned with the reflector forward of the front face or screen of the cover, and the battery pack 12 will be positioned against the rear or upper face of the combined cover and viewing screen. The engaged light assembly 14 will then be slid rearwardly to both clamp the laptop cover 18 between the battery pack and rear or outer edge 94 of the latch panel 90, and to also engage the latch panel under the cover flange 16 or, depending upon the model of laptop, a projecting latch tab 102 normally provided on this flange to lock the cover in its closed position over the keyboard. Thus, multiple features tend to stabilize the portable light in operative position, including the counterweight action of the battery pack, the frictional clamping between the battery pack and the rear edge of the latch flange 90, and the engagement of the latch flange beneath any forwardly projecting portion aligned therewith on the laptop cover 18.

From the foregoing, it will be appreciated that a highly effective light source has been provided for laptop computers, the light source being usable under all circumstances and, being independently powered, presenting no demands on the computer power supply itself. Further, the compact nature of the portable light in its stored position makes it easily carried, for example in a small pouch or case, which in turn allows the user to actually avail himself of multiple interchangeable battery packs, thus allowing continued use of the computer should one battery pack run down.

The foregoing is considered illustrative of the principles of the invention. As variations and related embodiments may occur to those skilled in the art, it is to be appreciated the invention, and all suitable modifications and equivalents, are only to be limited by the scope of the claims following hereinafter.

I claim:

1. A portable light comprising a battery pack and a light assembly, mounting means on said battery pack for selectively receiving and positioning said light assembly on said battery pack with said light assembly extending laterally from said battery pack in a use position, and storage means on said light assembly for selectively receiving and storing said battery pack on said light assembly with said battery pack extending linearly relative to said light assembly in a stored position; said light assembly comprising a reflector with an outer wall, a rear wall and opposed end walls defining an open face opposed to said outer wall, means for mounting a bulb within said reflector for projection of illumination through said open face, an elongate mounting panel generally coplanar with said reflector outer wall and extending rearwardly beyond said rear wall of said reflector, said mounting panel, in said use position, extending transversely across said battery pack and engaging said mounting means with said reflector being positioned in spaced relation to a side of said battery pack; said battery pack comprising a battery chamber, opposed first and second face walls, opposed first and second side walls, and opposed first and second end walls, said mounting means comprising slot means on said first end wall for slidably receiving said mounting panel positioned transversely to said battery pack.

2. The portable light of claim 1 wherein said mounting panel includes opposed longitudinal edges, said slot means comprising opposed slots slidably receiving said opposed longitudinal edges.

3. The portable light of claim 2 including a latching panel on said light assembly extending rearwardly relative to said rear wall of said reflector generally parallel to said mounting panel, said latching panel being of lessor length than said mounting panel and laterally spaced therefrom to define a rearwardly opening storage pocket comprising said storage means, said battery pack, in said stored position, being generally linearly aligned with said light assembly immediately below said mounting panel and with one of battery pack end walls, and an adjacent portion of said battery pack, received within said storage pocket.

4. The portable light of claim 3 including electrical contact means on said battery pack first end wall and on said light assembly mounting panel for electrical contact and power transfer upon reception of said mounting panel in said slot means.

5. The portable light of claim 4 wherein said battery pack includes a storage compartment separate from said battery chamber.

6. The portable light of claim 5 wherein said battery pack includes an openable closure panel for selective access to said battery chamber and said storage compartment.

7. A portable light comprising a battery pack and a light assembly, mounting means for selectively receiving and positioning said light assembly on said battery pack with said light assembly extending laterally from said battery pack in a use position, and storage means for selectively receiving and storing said battery pack on said light assembly with said battery pack extending linearly relative to said light assembly in a stored position; said light assembly comprising a reflector with an outer wall, a rear wall and opposed end walls defining an open face opposed to said outer wall, means for mounting a bulb within said reflector for projection of illumination through said open face, an elongate mounting panel generally coplanar with said reflector outer wall and extending rearwardly beyond said rear wall of said reflector, said mounting panel, in said use position, extending transversely across said battery pack with said reflector being positioned in spaced relation to a side of said battery pack, and a latching panel on said light assembly extending rearwardly relative to said rear wall of said reflector generally parallel to said mounting panel, said latching panel being of lessor length than said mounting panel and laterally spaced therefrom to define a latching member for cooperation with said battery pack in mounting said portable light on a structure to be illuminated.

8. A portable light for use on and as an illumination means for a laptop computer and the like having an upwardly positionable cover with a front face, a rear face, and an outer top edge with a laterally projecting portion; said portable light comprising a battery pack adapted to parallel the rear face of the cover, and a light assembly, mounting means for selectively receiving and positioning said light assembly on said battery pack with said light assembly extending laterally from said battery pack in a use position to extend over the top edge and beyond the front face of the cover, said light assembly comprising a reflector with an outer wall, a rear wall and opposed end walls defining an open face opposed to said outer wall, means for mounting a bulb within said reflector for projection of illumination through said open face, an elongate mounting panel generally coplanar with said reflector outer wall and extending rearwardly beyond said rear wall of said reflector, said mounting panel, in said use position, extending transversely across said battery pack and engaged thereto by said mounting means, said reflector being positioned in spaced relation to a side of said battery pack and including a latching panel extending rearwardly from said rear wall of said reflector generally parallel to said mounting panel, said latching panel being of lessor length than said mounting panel and laterally spaced therefrom to define a latching member for cooperation with said battery pack in mounting said portable light on a structure to be illuminated.

9. The portable light of claim 8 wherein said battery pack comprising a battery chamber, opposed first and second face walls, opposed first and second side walls, and opposed first and second end walls, said mounting means comprising slot means on said first end wall for slidably receiving said mounting panel positioned transversely to said battery pack.

10. The portable light of claim 9 wherein said mounting panel includes opposed longitudinal edges, said slot means comprising opposed slots slidably receiving said opposed longitudinal edges.

11. A portable light comprising a battery pack and a light assembly, mounting means on said battery pack for selectively receiving and positioning said light assembly on said battery pack with said light assembly extending laterally from said battery pack in a use position, and storage means for selectively storing said battery pack on said light assembly with said battery pack extending linearly relative to said light assembly in a stored position, said light assembly including a rear wall, means for mounting a bulb within said light assembly forward of said rear wall for projection of illumination, an elongate mounting panel on said light assembly extending rearwardly from said rear wall, said mounting panel, in said use position, extending transversely across said battery pack and engaging said mounting means with said means for mounting a light bulb positioned in spaced relation to a side of said battery pack, said battery pack comprising a battery chamber, said mounting means on said battery pack comprising slot means exterior of said battery chamber for slidably receiving said mounting panel therewithin and therethrough.

12. The portable light of claim 11 including electrical contact means on said battery pack exposed within said slot means, and cooperating contact means on said mounting panel of said light assembly for electrical contact with said contact means on said battery pack and power transfer upon reception of said mounting panel in said slot means.

13. The portable light of claim 11 including a latching panel on said light assembly extending rearwardly relative to said rear wall and generally parallel to said mounting panel, said latching panel being of lesser length than said mounting panel and laterally spaced therefrom to define a rearwardly opening storage pocket comprising said storage means, said battery pack, in said stored position, being generally linearly aligned with said light assembly immediately below said mounting panel and with a portion of said battery pack received within said storage pocket.

* * * * *